United States Patent [19]

Perlov

[11] Patent Number: 5,002,471

[45] Date of Patent: Mar. 26, 1991

[54] DISPOSABLE CELL AND DIAPHRAGM PUMP FOR USE OF SAME

[75] Inventor: Gena Perlov, Haifa, Israel

[73] Assignee: D.F. Laboratories Ltd., Haifa, Israel

[21] Appl. No.: 481,778

[22] Filed: Feb. 16, 1990

Related U.S. Application Data

[63] Continuation of Ser. No. 170,312, Mar. 18, 1988, abandoned.

[30] Foreign Application Priority Data

Jul. 20, 1987 [IL] Israel ..... 83259

[51] Int. Cl.[5] ..... F04B 43/02

[52] U.S. Cl. ..... 417/413; 417/479

[58] Field of Search ..... 417/395, 413, 478, 479; 92/48, 98 R, 99, 102, 104, 103 D

[56] References Cited

U.S. PATENT DOCUMENTS

| | | | |
|---|---|---|---|
| 3,039,399 | 6/1962 | Everett | 92/103 SD X |
| 3,496,872 | 2/1970 | Riester et al. | 417/413 X |
| 4,290,346 | 9/1981 | Bujan | 417/478 X |
| 4,391,600 | 7/1983 | Archibald | 417/478 X |
| 4,410,322 | 10/1983 | Archibald | 417/478 X |
| 4,479,761 | 10/1984 | Bilstad et al. | 417/479 X |
| 4,519,792 | 5/1985 | Dawe | 417/413 X |
| 4,560,324 | 12/1985 | Durieux | 417/385 X |
| 4,781,548 | 11/1988 | Alderson et al. | 417/478 |

OTHER PUBLICATIONS

Shepherd et al., A Pump, Nov. 7, 1985, WO85/04813.

*Primary Examiner*—Leonard E. Smith
*Assistant Examiner*—Eugene L. Szczecina, Jr.
*Attorney, Agent, or Firm*—Bauer & Schaffer

[57] ABSTRACT

A disposable cell for a diaphragm-actuated fluid-transfer control device, which comprises two cell walls peripherally joined to one another, of which at least one wall is flexible, and is adapted to be flexed from a first position, in which it is located in close proximity to the other wall, reducing the space enclosed between the two walls to a minimum, to at least a second position, in which at least some regions of the flexible wall have moved away from the other wall, thereby increasing the space between the two walls, and an inlet port and an outlet port provided in at least one of the walls. There is also described a combination of a disposable cell with a diaphragm-actuated fluid transfer control device.

15 Claims, 7 Drawing Sheets

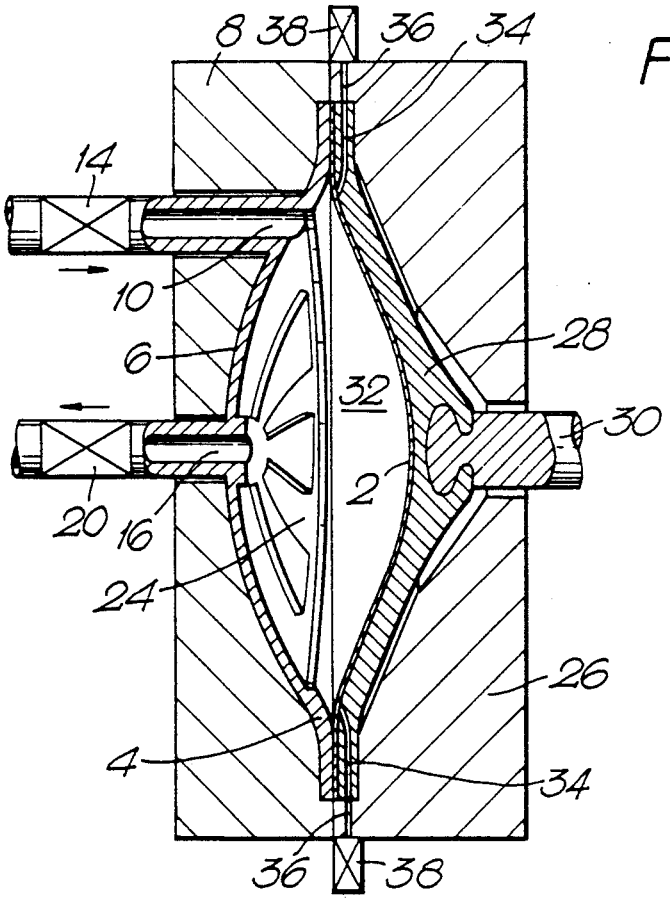
Fig. 4.
Fig. 5.
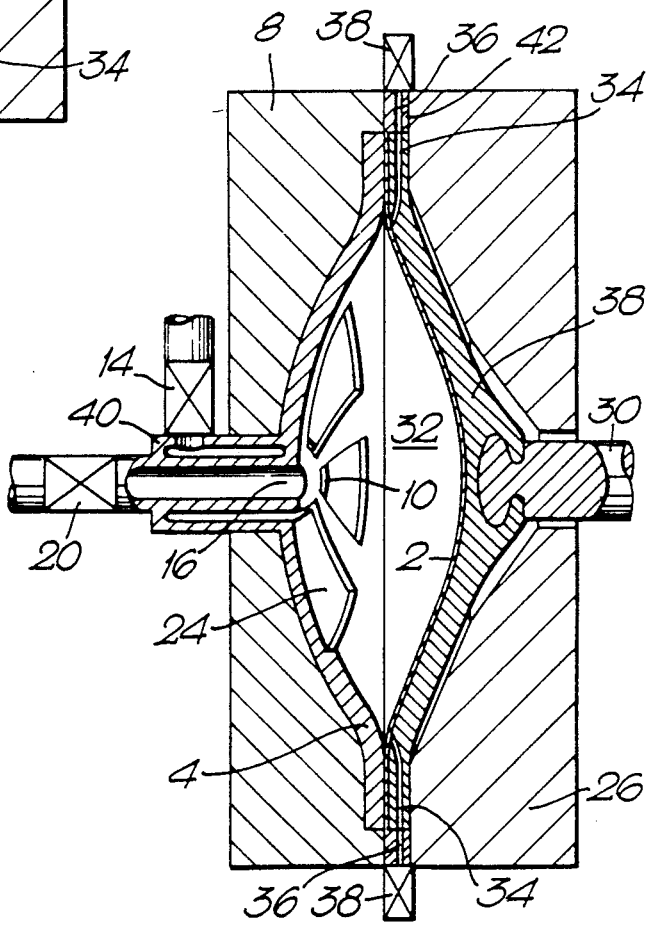

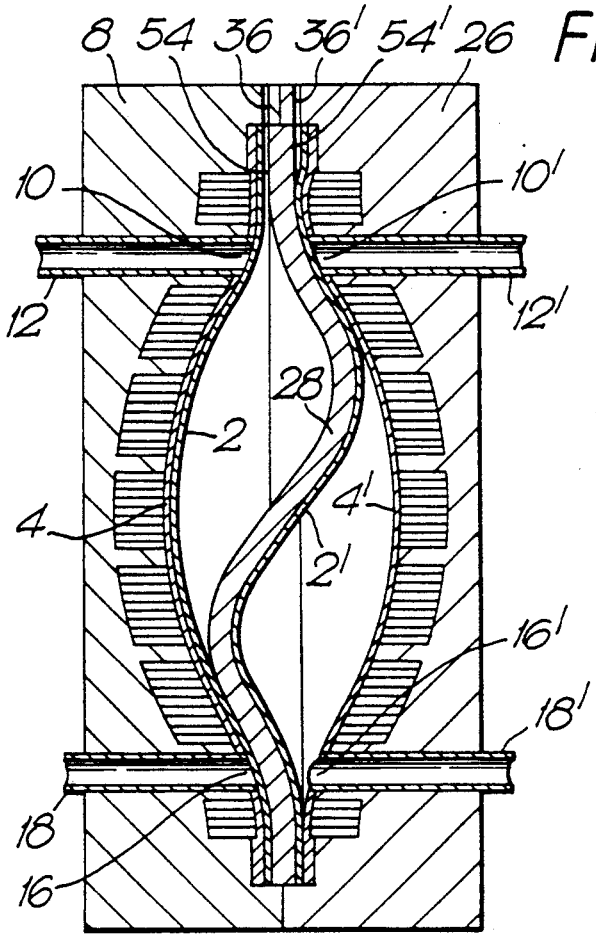
Fig. 14.
Fig. 15.
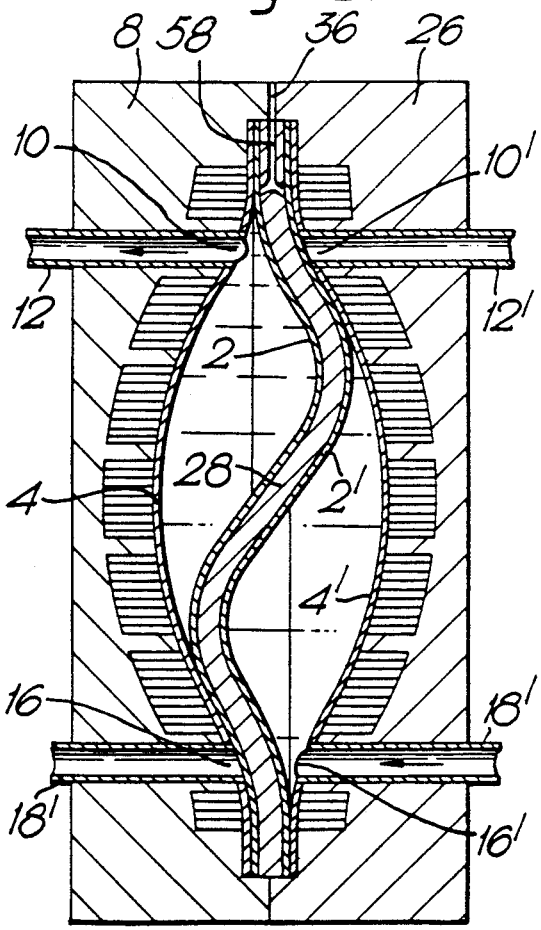

DISPOSABLE CELL AND DIAPHRAGM PUMP FOR USE OF SAME

This is a continuation of Ser. No.: 170,312 Filed: 3/18/88 now abandoned.

The present invention relates to a disposable cell for a diaphragm-actuated fluid-transfer control device, facilitating the passing therethrough, in dependence on the material the cell is made of, of any fluid, without the device either contaminating the fluid or being contaminated thereby. For the present purpose, such devices are meant to include diaphragm pumps as well as diaphragm valves.

Existing diaphragm pumps, for instance, have no disposable inner components and, to deal with the contamination problem, the entire pump body is replaced, leaving only the drive section. Such pumps are known as cassette diaphragm pumps and are relatively expensive. An analogous situation exists with diaphragm valves.

It is one of the objects of the present invention to overcome the disadvantages of the prior art diaphragm devices and to provide a disposable cell for these devices that solves the contamination problem and is much less expensive than the above-mentioned solutions, permitting the use of the housing of the original device and also of its diaphragm.

This the invention achieves by provides a disposable cell for a diaphragm-actuated fluid-transfer control device. The cell comprises two cell walls peripherally joined to one another, of which at least one wall is flexible, so as be flexed from a first position, in which it is located in close proximity to the other wall reducing the space enclosed between said two walls to a minimum, to at least a second position, in which at least some regions of the flexible wall are moved away from the other wall, thereby increasing the space between the two walls. A inlet port and an outlet port are provided in at least one of the walls.

The invention will now be described in connection with certain preferred embodiments with reference to the following illustrative figures so that it may be more fully understood.

The invention further provides in a diaphragm-actuated fluid-transfer control device, the improvement comprising a disposable cell having two cell walls peripherally joined to one another. At least one wall is flexible, attachable to, and capable of participating in the movement the diaphragm, so as to be flexed from a first position, in which it is located in close proximity to the other wall, reducing the space enclosed between said two walls to a minimum, to at least a second position, in which at least some regions of the flexible wall has moved away from the other wall, thereby increasing said space between the two walls. A inlet port the and an outlet port provided in at least one of the walls passages for releasing air trapped between at least the attachable flexible wall and said diaphragm, are provided in at least one region in the diaphragm.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 4 shows a schematic, cross-sectional view of a second embodiment of the disposable cell, as mounted in a diaphragm pump operated by a reciprocating rod;

FIG. 5 illustrates a variant of the embodiment of FIG. 4, in which both the inlet and the outlet valves are centrally located;

FIG. 14 shows two of the disposable cells of FIG. 10 as mounted in a magneto-electromechanical pump;

FIG. 15 illustrates the pump with the flexible walls attached to the two surfaces of the pump diaphragm.

Figure 1:
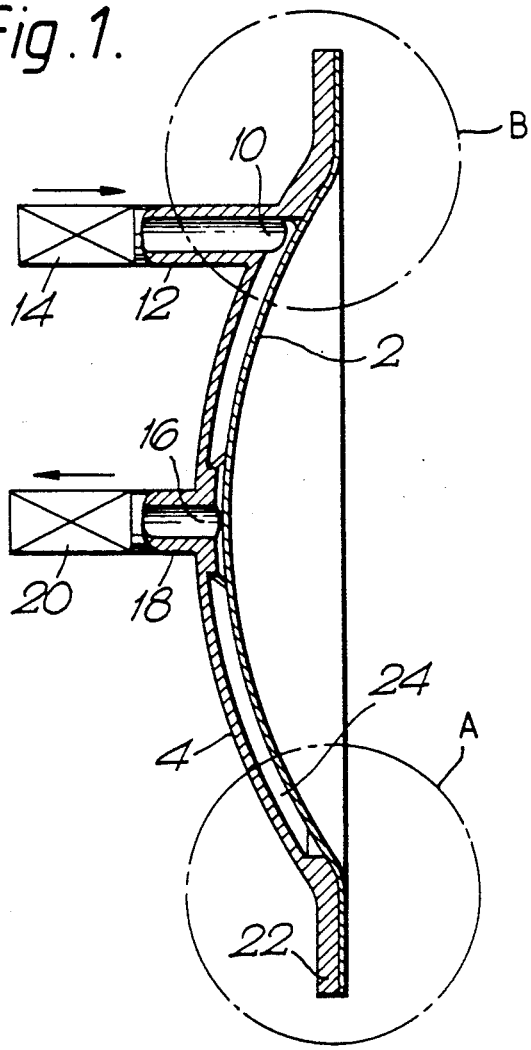
FIG. 1 is a schematic, cross-sectional view of a first embodiment of the disposable cell according to the invention.
Figure 2:
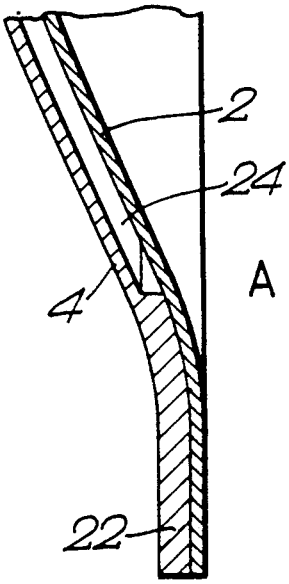
FIG. 2 is an enlarged view of the portion A of FIG. 1.
Figure 3:
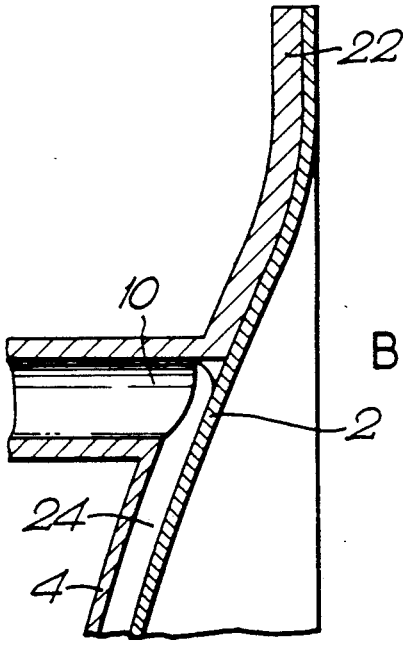
FIG. 3 is an enlarged view of the portion B of FIG. 1.

Referring now to the drawings, there is seen in FIGS. 1 to 3 a disposable cell mountable in a diaphragm pump as illustrated in FIG. 4 and comprising an elastically flexible wall 2 which, in FIG. 1, is seen to touch a second wall 4 which, in this embodiment, is rigid and, with its convex face, accurately fits the concave cavity surface 6 of the pump housing half 8 (FIG. 5). Further seen, also in the enlarged detail B of FIG. 3, is an inlet port 10 communicating via a socket 12 with a nonreturn valve that serves as inlet valve 14 and an outlet port 16 communicating via another socket 18 with a nonreturn valve serving as outlet valve 20.

The two walls 2 and 4 are joined at the peripheral, flange-like rim 22 of the latter, which also serves for tightly mounting the cell inside the pump housing, as seen in FIG. 4 (in which, for reasons of clarity, the clamping means have been omitted).

Further seen are recesses 24 in the rigid wall 4 fanning out from a central boss as clearly seen in FIG. 4, where they are not covered by the flexible wall 2. The function of these recesses is to facilitate inflow and to prevent fluid from being trapped at the end of the output stroke of the flexible wall 2.

FIG. 4, as already mentioned, shows the disposable cell according to the invention as mounted in a standard diaphragm pump which comprises the first housing half 8, a second housing half 26, a pump diaphragm 28 and an actuator rod 30 adapted to perform a linearly reciprocating movement produced by, e.g., a solenoid, a cam drive, a piston or the like.

In the position shown, which corresponds to the end of the suction stroke, the flexible wall 2, in a manner to be discussed further below, has attached itself to the inner surface of the pump diaphragm 28, thus creating a working space 32 which, as can be seen, is completely isolated from all members of the pump proper.

Seen are also narrow ducts 34 which, registering with similar ducts 36 in the housing half 26, lead to bleeder valves 38. These are nonreturn valves that permit air to exit, but prevent its return.

"Priming" of the pump, which involves the attachment of the flexible wall 2 to the inside surface of the pump diaphragm 28, is carried out in the following way:

The cell having been mounted in the pump body, the pump is actuated. During the first expulsion stroke, the pump diaphragm 28 moves towards the flexible wall 2 of the cell which, initially, may be in a fairly flat, intermediate position. Before the diaphragm 28 reaches the flexible wall 2, all the air in the space between wall 2 and diaphragm 28 is expelled through the ducts 34, 36 and the nonreturn, bleeder valves 38. At the end of the expulsion stroke, the diaphragm 28 has made full contact with the flexible wall 2 and has pressed it against the rigid wall 4, the relative positions of these two walls being as shown in FIG. 1. With the suction stroke of the diaphragm 28 which follows the expulsion stroke, the flexible wall 2 cannot separate from the diaphragm 28, because such separation would mean the creation of a vacuum between wall 2 and diaphragm 28, as the bleeder valves 38 will not permit return of the air expelled during the "priming" stroke. The flexible wall 2 is thus pulled along by the retreating diaphragm 28, producing a suction effect which causes the fluid to enter the working space 32 through the suction or inlet valve 14. With the subsequent expulsion stroke of the diaphragm 28, the fluid is expelled through the outlet port 16 and the outlet valve 20.

For better adhesion of the flexible wall 2 of the cell to the diaphragm 28, it is possible to provide either the wall 2 or the diaphragm 28 with an adhesive layer which, after the "priming" stroke, will cause these surfaces to stick together, even if one or more bleeder valve 38 should fail in their nonreturn function. The adhesive used must obviously be of the nonsetting or noncuring type so that when the disposable cell has to be removed, say, for a change of working fluid, the flexible wall 2 is easily peeled off the diaphragm 28.

In the embodiment of FIG. 5 the inlet ports 10 are arranged concentrically around the central outlet port 16. To introduce the cell into, or remove it from, the housing half 8, the inlet valve 14 can be unscrewed from the central valving stem 40. In a further difference with respect to the embodiment of FIG. 4, the bleeder ducts 36 are arranged in an annular member 42 rather than in the housing half 26.

Figure 16:
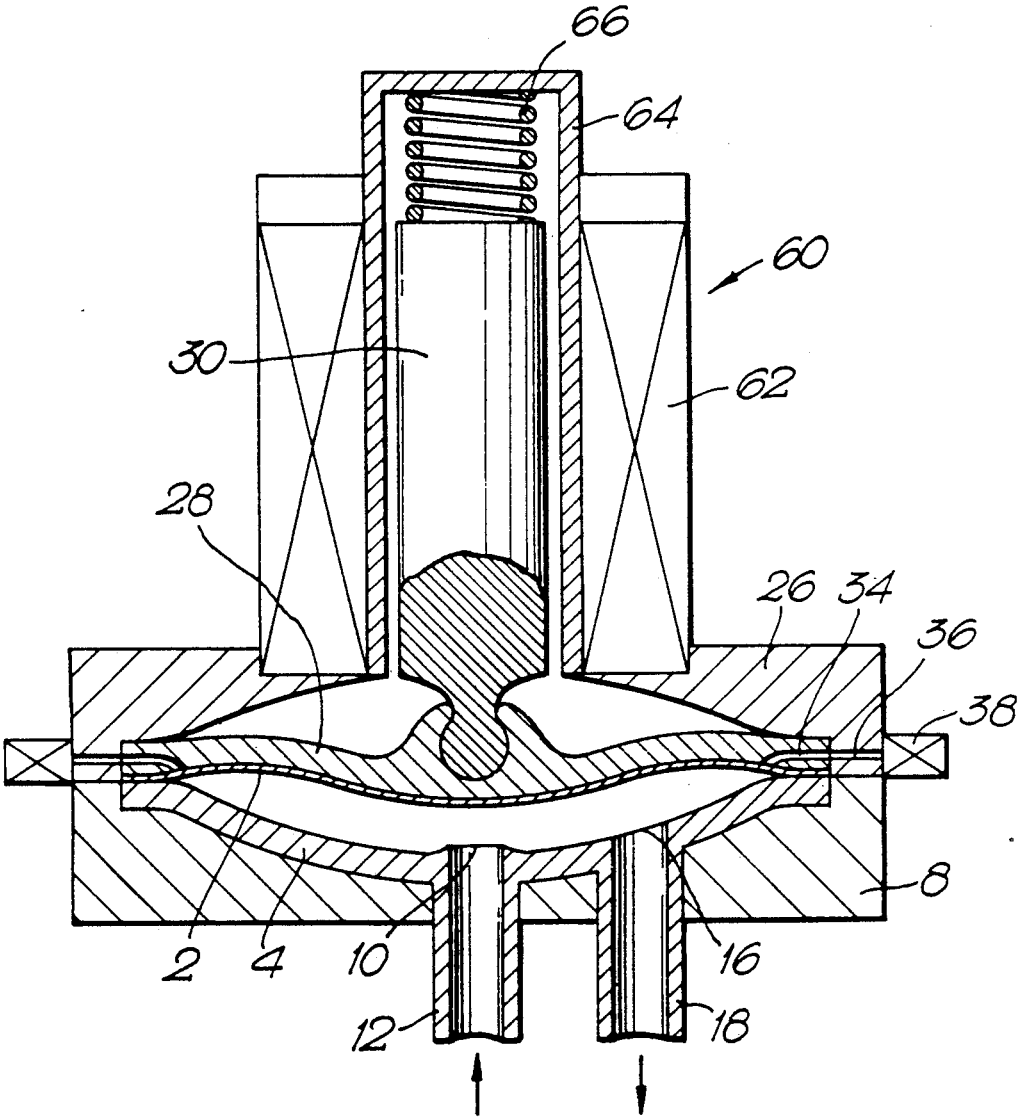
FIG. 16 shows a diaphragm valve incorporating the disposable cell according to the invention.

Another way of eliminating air pockets, i.e., of releasing air trapped between the wall 2 and the diaphragm 28 in such embodiments as illustrated in FIGS. 4, 5 and 16 would be to make use of the above-mentioned adhesive layer in conjunction with a porous, or partially porous, diaphragm 28. Any air trapped during the "priming" stage could escape through the porous diaphragm into the naturally vented space behind the latter. The wall 2 would then serve as the active, necessarily non-porous, surface of the diaphragm 28. Such an arrangement would obviate the need for the bleeder ducts 36 and, in the embodiment of FIG. 5, the annular member 42.

Figure 6:
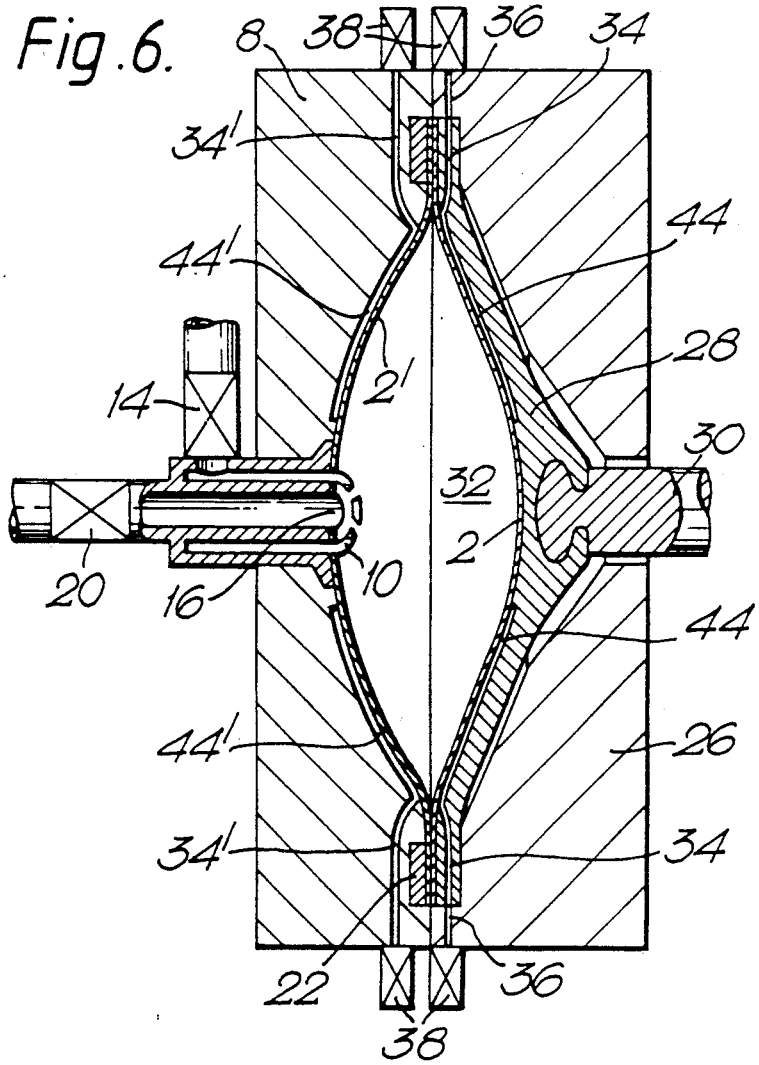
FIG. 6 illustrates a variant of the disposable cell of FIG. 5, in which both cell walls are flexible.

FIG. 6 illustrates a variant of the embodiment of FIG. 5, in which there is provided a disposable cell having two flexible walls 2, 2'. The wall 2' is attached to the cavity surface of the housing half 8 in the same "priming" procedure during which the wall 2 is attached to the inner surface of the pump diaphragm 28. To facilitate elimination of air pockets, there are provided grooves 44 in the diaphragm surface which lead into the bleeding ducts 34. Similar grooves, 44' are provided in the cavity surface of housing half 8, which lead into bleeding ducts 34'.

Figure 7:
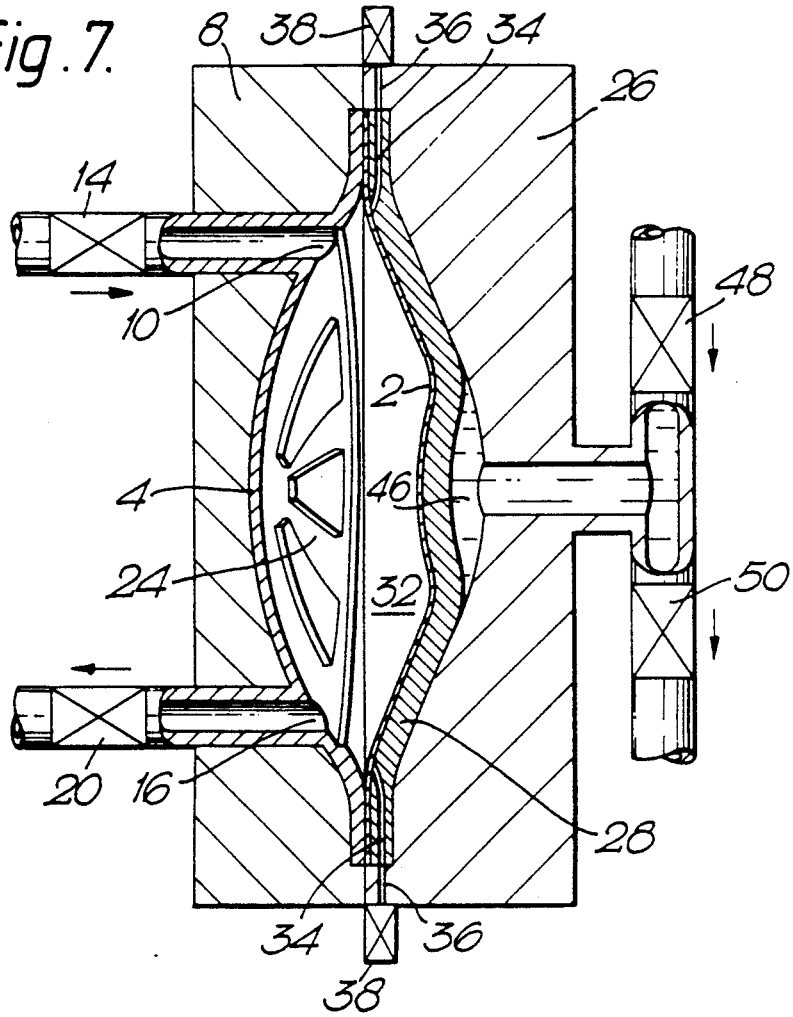
FIG. 7 is a further embodiment of the disposable cell as mounted in a hydraulically or pneumatically operated pump.

FIG. 7 illustrates a disposable cell as used in a hydraulically or pneumatically operated diaphragm pump. The cell is seen to consist of a flexible wall 2 and a rigid wall 4 with peripherally located ports 10 and 16 and the inlet and outlet valves 14 and 20 associated with these ports. The pulsating hydraulic or pneumatic working fluid 46 is controlled by valves 48 and 50.

Figure 8:
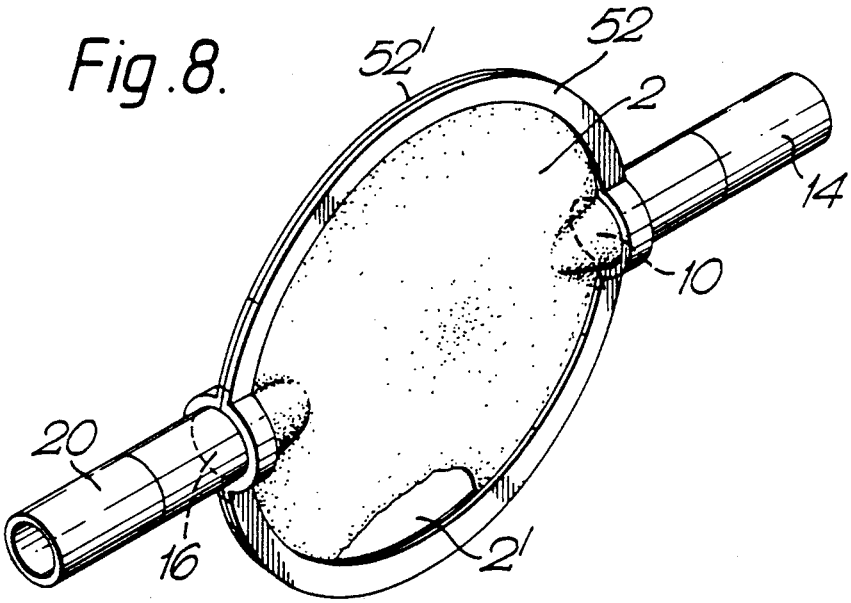
FIG. 8 is a perspective view of yet another embodiment of the disposable cell having two flexible walls.

FIG. 8 shows a disposable cell having two flexible walls 2, 2' and peripheral, diametrically opposite inlet and outlet ports 10 and 16, the whole held together by flanges 52, 52'.

Figure 9:
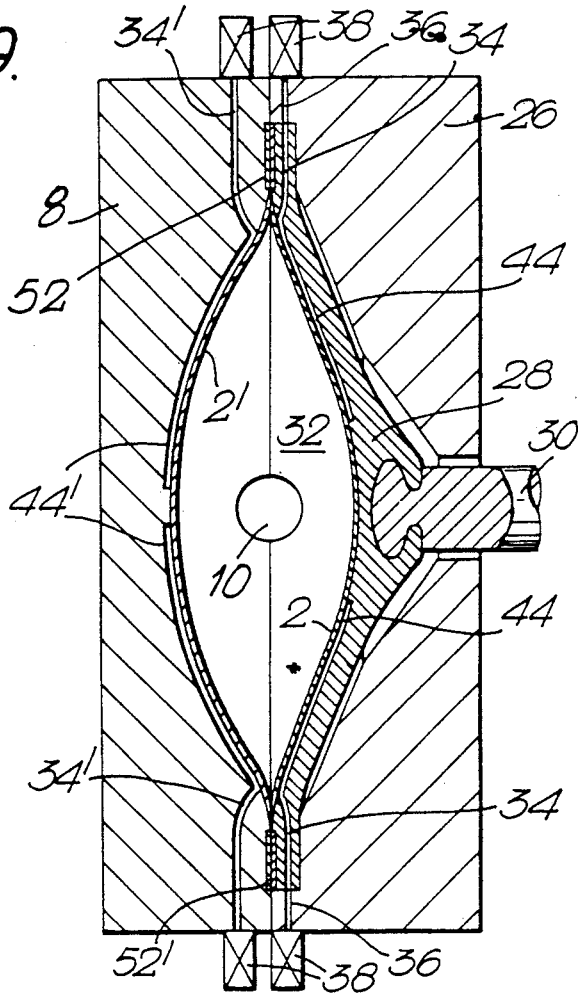
FIG. 9 is a cross-sectional view, showing the cell of FIG. 8 as mounted in a rod-operated diaphragm pump.

A diaphragm pump using such a cell is shown in FIG. 9 and is similar to the embodiment of FIG. 6, except for the peripheral, diametrically opposite inlet and outlet facilities.

Figure 10:
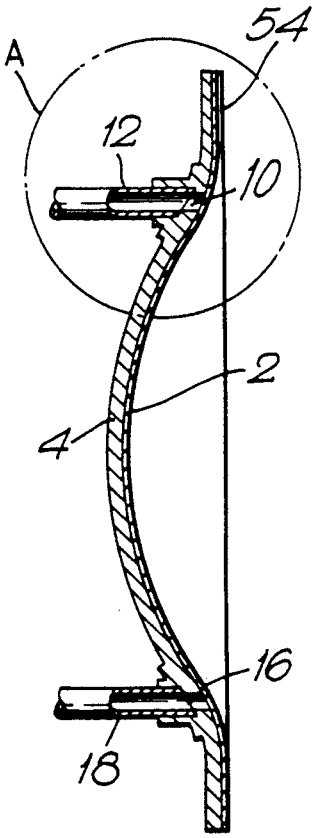
FIG. 10 is a schematic, cross-sectional view of a disposable cell for a magneto-electromechanical diaphragm pump having no valves.

FIG. 10 illustrates a disposable cell for use in a magneto-electro-mechanical diaphragm pump such as disclosed in U.S. Pat. No. 4,498,850, represented in FIGS. 14 and 15.

Figure 12:
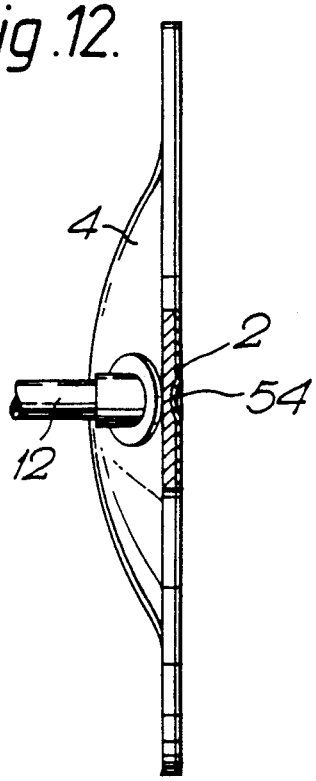
FIG. 12 is a view in cross section along plane XII—XII of FIG. 11.
Figure 11:
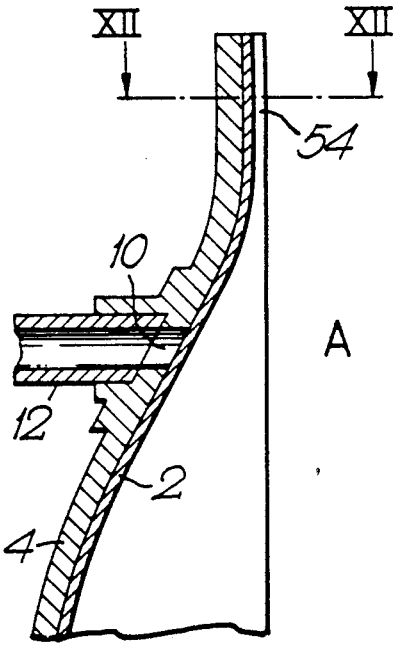
FIG. 11 is an enlarged view of the portion A of FIG. 10.

The cell of which the above-mentioned pump uses two, comprises a flexible wall 2, a thin, but rigid wall 4, a peripheral inlet port 16, a peripheral outlet port 10, and the respective sockets 18 and 12. As explained in the above disclosure, this pump needs no valves. Near the outlet port 10, the flange-like rim of the rigid wall 4 is provided with a trough-like recess 54, lined with part of the rim portion of the flexible wall and shown to better advantage in the enlarged detail A of FIG. 11 and the top view of FIG. 12, sectioned along the plane XII—XII of FIG. 11. The purpose of this recess is to facilitate escape of the air during the "priming" stage in which the flexible walls 2, 2' of each of the disposable cells are being attached to the respective surfaces of the pump diaphragm 28 (see FIG. 4).

Figure 13:
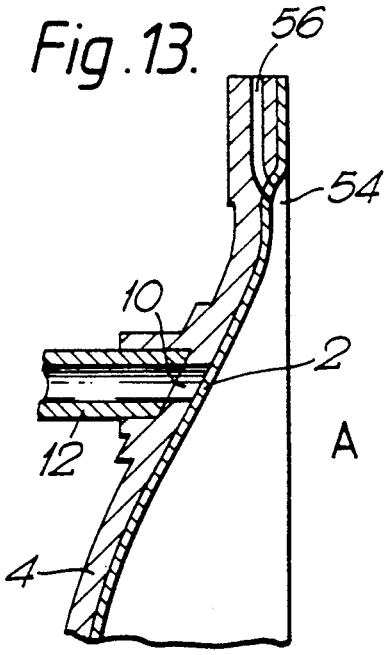
FIG. 13 represents a different configuration of portion A of FIG. 10.

FIG. 13 represents a different configuration of the detail A of FIG. 10. Here, the recess 54 does not lead right to the edge of the rim, but ends somewhat below the edge. Escape of the air trapped between the flexible wall 2 and the pump diaphragm 28 (see FIG. 14) is facilitated by a duct 56 which, in the assembled pump (not shown with this embodiment), leads via an appropriately located bore in the pump housing into the atmosphere.

FIG. 14 shows the disposable cells of FIG. 10 as mounted in the above-mentioned pump which is of the peristaltic type and the operation of which is described in the above U.S. Patent. It is seen that the flexible wall 2' is already attached to the right-hand surface of the diaphragm 28. It is also seen that the recess 54' is now pinched off and will remain closed even when, in continuation of the "priming" process, the upper part of the diaphragm 28 will flip over to the left, because of the pressure prevailing at the upper region near the outlet ports 10, 10', which produces a pressure difference acting on the flexible wall 2.

Also seen are bores 36, 36' provided in the housing halves 8, 26 and located in alignment with the recesses 54, 54'.

The fully "primed" pump is shown in FIG. 15, where also the flexible wall 2 of the left cell is seen to have become attached to the diaphragm 28.

In this drawing, however, a variant of the air-bleeding arrangement of FIGS. 10–14 is shown. Instead of the recesses 54, 54' in the flange-like rims of the rigid cell walls 4, 4' there is provided a radial duct 58 leading at its upper end via a single duct 36 into the atmosphere and, at its lower end, branching out towards the left and the right, thus opening onto both surfaces of the diaphragm 28. It is through these surface openings that the air can escape during the "priming" stage in which the flexible walls 2, 2' are attached to the respective diaphragm surfaces. Again, once attached, the overpressure in the upper region of the pump will keep these diaphragm-surface openings closed under all circumstances.

FIG. 16 illustrates the use of the disposable cell according to the invention in a solenoid-actuated diaphragm valve.

The cell, mounted in the split body of the valve comprises the flexible wall 2 and the rigid wall 4, in an arrangement similar to that shown in the diaphragm pump of FIG. 4, including the air bleeding ducts 34 in the diaphragm 28, their continuation 36 in the valve body, and the bleeder valves 38. The actuator rod 30, the lower end of which is articulated to the diaphragm 28, is in this embodiment part of the armature of a solenoid 60 which comprises a coil 62 connectable to a power source, a guide sleeve 64 in which the rod 30 can smoothly move, and a helical spring 66 by which the valve diaphragm 28 is biased towards the closed position of the valve.

The cell has an inlet port 10 with a slightly raised rim for increased contact pressure in the closed state of the valve, an inlet socket 12, an outlet port 16 and an outlet socket 18. Attachment of the flexible wall 2 of the surface of the diaphragm 28 is carried out in the same way as was explained in conjunction with the embodiment of FIG. 4.

Operation of the valve is almost self-explanatory. As shown in FIG. 16, the valve is in the "open" position, i.e., the solenoid 60 has been energized and drawn the rod 30 into its upper position inside the sleeve 64, against the restoring force of the spring 66. Once in this position, a mechanical locking feature takes over, so that the solenoid need not be kept under current to maintain the "open" state of the valve. For closing the valve, a further current impulse is applied, which releases the lock and permits the spring 66 to push the rod 30 down, causing the flexible wall 2 to be pressed against, and thereby closing, the inlet port 10.

In certain types of diaphragm pumps in which the latter can either be stopped with the pump diaphragm 28 at the outermost position of the expulsion stroke, or in which the diaphragm 28 can be brought to this position manually, a version of the cell, mentioned in conjunction with FIGS. 1–4 before, can be used that would combine the otherwise separate stages of mounting the cell and "priming" the pump in a single stage and would also obviate the need for the ducts 34,36 and the non-return bleeder valves 38. In this version, the flexible wall 2, rather than touching, in the unmounted state of the cell, the inside of the rigid wall 4, is fairly flat, stretched across the flange-like rim 22. For mounting (and "priming"), the cell is introduced into the cavity of the housing half 8, and the other housing half 26, with the pump diaphragm 28 now in the aforementioned extreme, outwardly bulging position, is applied against the first half 8 prior to clamping. First to touch and depress the initially flat wall 2 is the central, protruding portion of the diaphragm 28, and the closer the two housing halves 8,26 approach one another, the more does this contact spread gradually outwards toward the periphery, and as the faces of the housing halves are not completely touching until the very last moment of the mounting operation, there is no problem of air being trapped between the flexible wall 2 and the diaphragm 28. There is, therefore, no need for the passages 34,36 and the bleeder valve 38. When the two halves 8,26 are tightly clamped, the flexible wall 2 will have assumed the position shown in FIG. 4.

It will be evident to those skilled in the art that the invention is not limited to the details of the foregoing illustrative embodiments and that the present invention may be embodied in other specific forms without departing from the spirit or essential attributes thereof.

What is claimed is:

1. A disposable cell for mounting inside a diaphragm-actuated, positive-suction and expulsion fluid-transfer control device having a split housing comprised of two substantially contiguous halves with said cell being clamped at its periphery between a peripheral zone of one half of said split housing and a peripheral zone of said diaphragm, comprising:

two cell walls permanently and fluid-tightly joined to one another at their periphery, both of which walls are flexible, one of said walls being adapted to be flexed from a first position, in which it is located in close proximity to the other wall, reducing the space enclosed by said two walls, to at least a second position, in which at least some regions of said one wall have moved away from said other wall, thereby increasing said space between said two walls, and an inlet port and an outlet port provided in at least one of said walls, wherein in the mounted and operative state of said disposable cell, the walls thereof constitute an impervious lining of one half of said split housing on the one end, and of said diaphragm on the other.

2. The disposable cell a claimed in claim 1, wherein one of said walls is rigid and is provided with a flange-like rim.

3. The disposable cell as claimed in claim 1, further comprising an inlet valve communicating with said inlet port, and an outlet valve communication with said outlet port.

4. The disposable cell as claimed in claim 2, wherein said flange-like rim is provided with at least one, substantially radial trough-like recess extending across the entire width of the rim.

5. The disposable cell as claimed in claim 4, wherein said trough-like recess extends from the inner edge of said rim to a point below the outer edge thereof, further comprising a duct leading from a point within said recess through said rim to the outside edge thereof.

6. The disposable cell as claimed in claim 1, wherein the outer face of at least one of said flexible walls is provided with an adhesive coating.

7. In a diaphragm-actuated, positive-suction and expulsion stroke fluid-transfer control device having a split constituted by two substantially contiguous halves, an improvement comprising:

a disposable cell for mounting inside said split housing, being clamped at its periphery between a peripheral zone of one half of said split housing and a peripheral zone of said diaphragm, said cell having two cell walls permanently and fluid-tightly joined to one another at their periphery, both of which walls are flexible, one of said walls being attachable to, and capable of participating in the movement of, said diaphragm, said one wall being adapted to be flexed from a first position, in which it is located in close proximity to the other wall, reducing the space enclosed by said two walls, to at least a second position, in which at least some regions of said at least one wall have moved away from said other wall, thereby increaing said space between said two walls, an inlet port and an outlet port provided in at least one of said walls, and means for releasing air trapped between at least said attachable flexible wall and said diaphragm, said means comprising at least one region in said diaphragm adapted to pass air, wherein in the mounted and operative state of said disposable cell, the walls thereof constitute an impervious lining of one half of said split housing on the one hand, and of said diaphragm on the other.

8. The fluid-transfer control device as claimed in claim 7, further comprising at least one air-bleed duct in at least one part of said split housing.

9. The fluid-transfer control device as claimed in claim 8, wherein said at least one air-bleeding duct is provided with a non-return valve permitting trapped air to pass from said air-bleeding duct via said valve into the atmosphere, but preventing air from the atmosphere from re-entering said at least one air-bleeding duct.

10. The fluid-transfer control device as claimed in claim 7, wherein said region is comprised of at least one air duct leading from at least one surface of said diaphragm to said at least one air-bleeding duct in said at least one housing part.

11. The fluid-transfer control device as claimed in claim, 7 wherein said air-bleeding duct or ducts are provided with non-return valves permitting said trapped air to pass from said air-bleeding ducts via said valves into the atmosphere, but preventing air from the atmosphere from re-entering said air-bleeding ducts.

12. The disposable cell as claimed in claim 7, further comprising an inlet valve communicating with said inlet port, and an outlet valve communication with said outlet port.

13. A disposable cell for mounting inside a diaphragm-actuated, positive suction and expulsion stroke fluid-transfer control device having a suction and expulsion stroke fluid-transfer control device having a split housing comprised of two substantially contiguous halves, with said cell being clamped at its periphery between a peripheral zone of one half of said split housing and a peripheral zone of said diaphragm, comprising:

two flexible cell walls permanently and fluid-tightly joined to one another at their periphery, one of said walls being adapted to be flexed from a first position, in which it is located in close proximity to the other wall, reducing the space enclosed by said two walls, to at least a second position, in which at least some regions of said one wall have moved away from said other wall, thereby increasing said space between said two walls, an inlet port and an outlet port provided in at least oen of said walls, wherein in the mounted and operative state of said disposable cell, the walls thereof constitute an impervious lining of one half of said split housing on the one hand, and of said diaphragm on the other.

14. The disposable cell as claimed in claim 13, further comprising an inlet valve communicating with said inlet port, and an outlet valve communication with said outlet port.

15. A positive-suction and expulsion stroke fluid-transfer control device, comprising:

a split housing comprised of two substantially contiguous halves;

a diaphragm linearly reciprocatable by means of an actuator rod and clampedly mounted at its periphery between peripheral zones of the members of said split housing:

a disposable cell consisting of two cell walls permanently and fluid-tightly joined to one another at their periphery, with said cell being clamped at its periphery between a peripheral zone of one half of said split housing and a peripheral zone of said diaphragm, both of which walls are flexible, one of said walls being adapted to be flexed from a first position, in which it is located in close proximity to the other wall, reducing the space enclosed by said two walls, to at least a second position, in which at least some regions of said one wall have moved away from said other wall, thereby increasing said space between said two walls, and an inlet port and an outlet port provided in at least one of said walls, wherein in the mounted and operative state of said disposable cell, the walls thereof constitute an impervious lining of one half of said split housing on the one hand, and of said diaphragm on the other.

* * * * *